US006851977B2

(12) United States Patent
Tsuji

(10) Patent No.: US 6,851,977 B2
(45) Date of Patent: Feb. 8, 2005

(54) CONNECTOR HOUSING WITH RESILIENT LOCK HAVING INCREASED RIGIDITY

(75) Inventor: Takeshi Tsuji, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/353,238

(22) Filed: Jan. 28, 2003

(65) Prior Publication Data

US 2003/0157820 A1 Aug. 21, 2003

(30) Foreign Application Priority Data

Feb. 15, 2002 (JP) ..... 2002-038940

(51) Int. Cl.[7] ..... H01R 13/40
(52) U.S. Cl. ..... 439/595; 439/884
(58) Field of Search ..... 439/595, 744, 439/871, 752.5, 884, 885

(56) References Cited

U.S. PATENT DOCUMENTS 5,186,662 A * 2/1993 Yuasa et al. ..... 439/752

FOREIGN PATENT DOCUMENTS

JP 5-23441 3/1993

* cited by examiner

*Primary Examiner*—Javaid H. Nasri
(74) *Attorney, Agent, or Firm*—Gerald E. Hespos; Anthony J. Casella

(57) ABSTRACT

A connector has a housing (10) with cavities (11) and a lock (17) in each cavity (11) for locking a terminal fitting (40). Each lock (17) has thin portions (17B) formed by partially cutting a surface thereof facing a deformation permitting space and a thick portion (17A) thicker than the thinner portions (17B). Deformation-preventing portions (32) are insertable into recesses formed by a difference in the thickness between the thick and thin portions (17A, 17B) to restrict resilient deformation of the locks (17). The connector can be made smaller because the locks (17) and the deformation-preventing portions (32) overlap along the thickness direction.

16 Claims, 13 Drawing Sheets

CONNECTOR HOUSING WITH RESILIENT LOCK HAVING INCREASED RIGIDITY

BACKGROUND OF THE INVENTION

1. Field of the Invention

The invention relates to a connector with a front retainer.

2. Description of the Related Art

Japanese Unexamined Patent Publication No. 5-23441 discloses a connector with a housing and with cavities that extend through the housing in a front to rear direction. Locks are cantilevered forwardly in the housing and extend along inner wall surfaces of the cavities. Deformation permitting spaces are formed in the housing adjacent the locks for permitting resilient deformation of the locks. Terminal fittings are inserted into the cavities from behind and are locked by the corresponding locks. A front retainer is mounted to a front end of the housing and has deformation preventing portions that enter the deformation permitting spaces of the housing to prevent the locks from being deformed away from the terminal fittings. As a result the terminal fittings are locked doubly and are prevented from coming out.

The above-described connector requires a dimension that is the sum of the thickness of a lock in its free state and the height of the deformation permitting space as measured in a resilient deforming direction of the lock. The connector can be miniaturized either by thinning the locks or reducing a degree of resilient deformation of the locks. However, the rigidity and strength of the locks is reduced by thinning, and the thinner locks may have a less reliable locking function. On the other hand, shorter deformation permitting spaces require thinner deformation preventing portions. Thin deformation preventing portions are less rigid and more likely to break.

The present invention was developed in view of the above problems and an object thereof is to miniaturize a connector without reducing the strengths of locks and the deformation preventing portions.

SUMMARY OF THE INVENTION

The invention relates to a connector with a housing and cavities that extend between opposite front and rear ends of the housing. Locks are cantilevered to extend forward and/or inward substantially along an inner wall of each cavity. Deformation permitting spaces also are formed in the housing for permitting deformation of the corresponding locks. Terminal fittings can be inserted into the cavities in an insertion direction, preferably from behind, and are locked by the corresponding locks. Each lock comprises at least one thin portion formed by partially cutting a surface of the lock facing the deformation permitting space. Each lock also has a portion that is thicker along the deflection direction of the corresponding lock.

Each lock is thinned over only part of the width. Thus, a sufficient strength can be secured for the entire lock.

Deformation preventing portions of a retainer may enter the deformation permitting spaces to prevent the locks from deforming away from the terminal fittings. Each deformation preventing portion may enter a recess formed by a difference in thickness between the thick portion and the thin portion of the lock and may contact the thin portion to prevent deformation of the lock. More particularly, the deformation preventing portions preferably are fit into deformation permitting spaces between the thin portions and the partition walls between the cavities. The retainer preferably is a front retainer mounted on front of the housing.

The locks and the deformation preventing portions overlap along the thickness direction, which is the deformation direction of the lock. Thus, the connector can be made smaller by this overlapping thickness. Further, parts of the deformation permitting spaces corresponding to the thin portions of the lock have a large height. Therefore, the thickness of the deformation preventing portions that contact the thin portions of the lock are larger, and a sufficient strength can also be secured for the deformation preventing portions.

Deformation permitting spaces for the thick portions preferably are defined by partially cutting portions of partition walls between the cavities corresponding to the thick portions. The deformation permitting spaces for the thick portions of the locks and the partition walls between the cavities overlap along thickness direction. Thus, the connector is made smaller by the overlapping thickness. The thick portions of the lock project toward the deformation permitting spaces and could restrict the resilient deformation of the locks. However, the deformation permitting spaces for the thick portions are formed in the partition walls between the cavities. Thus, the degree of the resilient deformation of each lock is larger, thereby increasing an area of engagement of the lock and the terminal fitting to lock the terminal fitting with improved reliability.

Each deformation permitting space for the thick portion provides communication between the cavities at the opposite sides of the corresponding partition wall. Thus, the resilient deformation of the locks is not restricted by the contact of the thick portions of the lock with the partition walls.

An area of a partition wall corresponding to the thin portion of the lock serves as an excessive deformation preventing portion for preventing an excessive deformation of the corresponding lock beyond its resiliency limit by contacting the thin portion.

Each lock preferably is substantially transversely symmetrically, such that the thick portion is in the widthwise center and thin portions are at the opposite widthwise sides of the thick portion. Thus, the rigidity of each lock also is transversely symmetrical, and the locks do not displace to either the left or right when being deformed in the process of inserting the terminal fitting.

Preferably, the lock comprises a locking section at the end for engaging and locking the terminal fitting.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
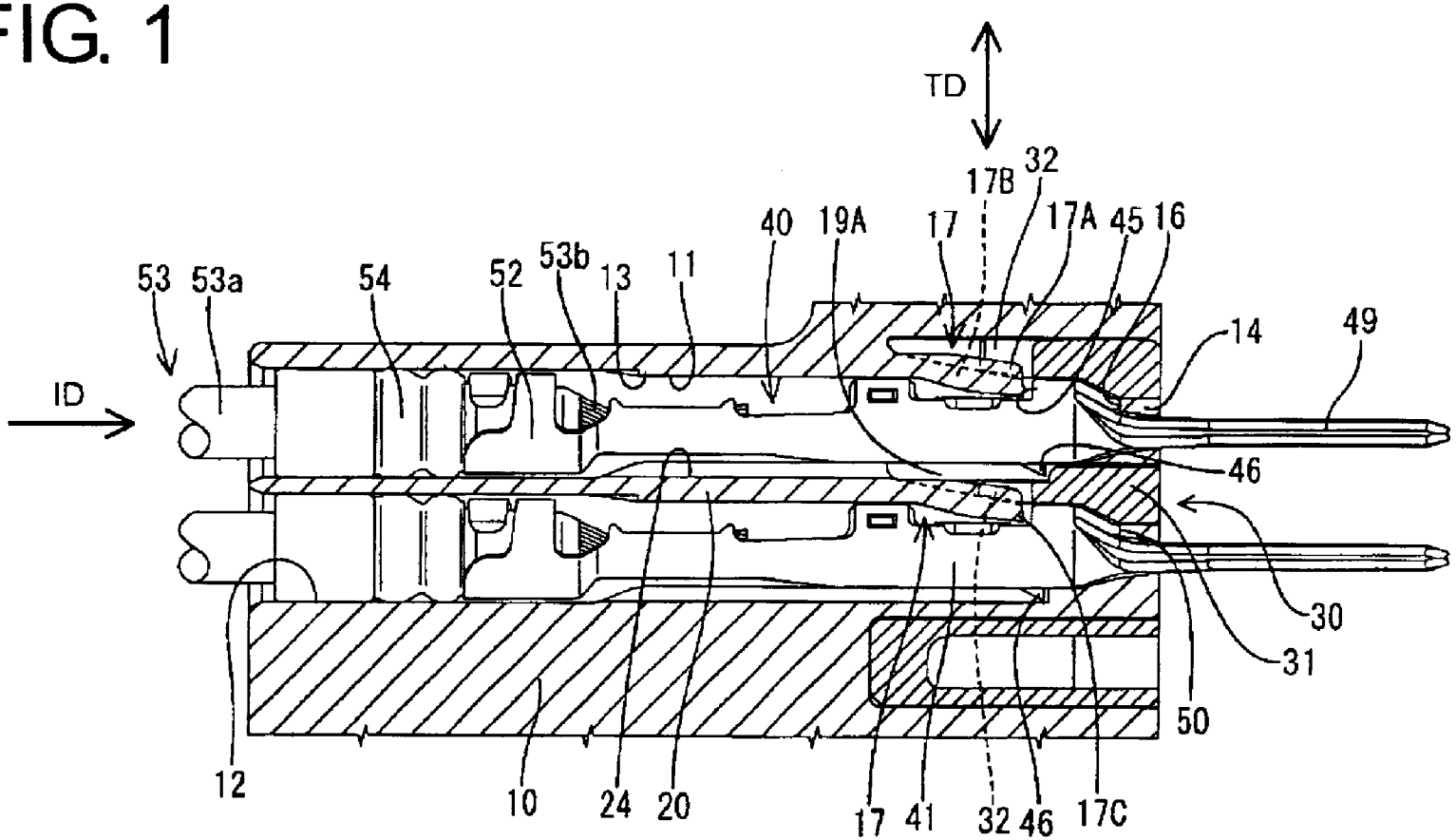
FIG. 1 is a section of an assembled connector according to one preferred embodiment of the invention.
Figure 2:
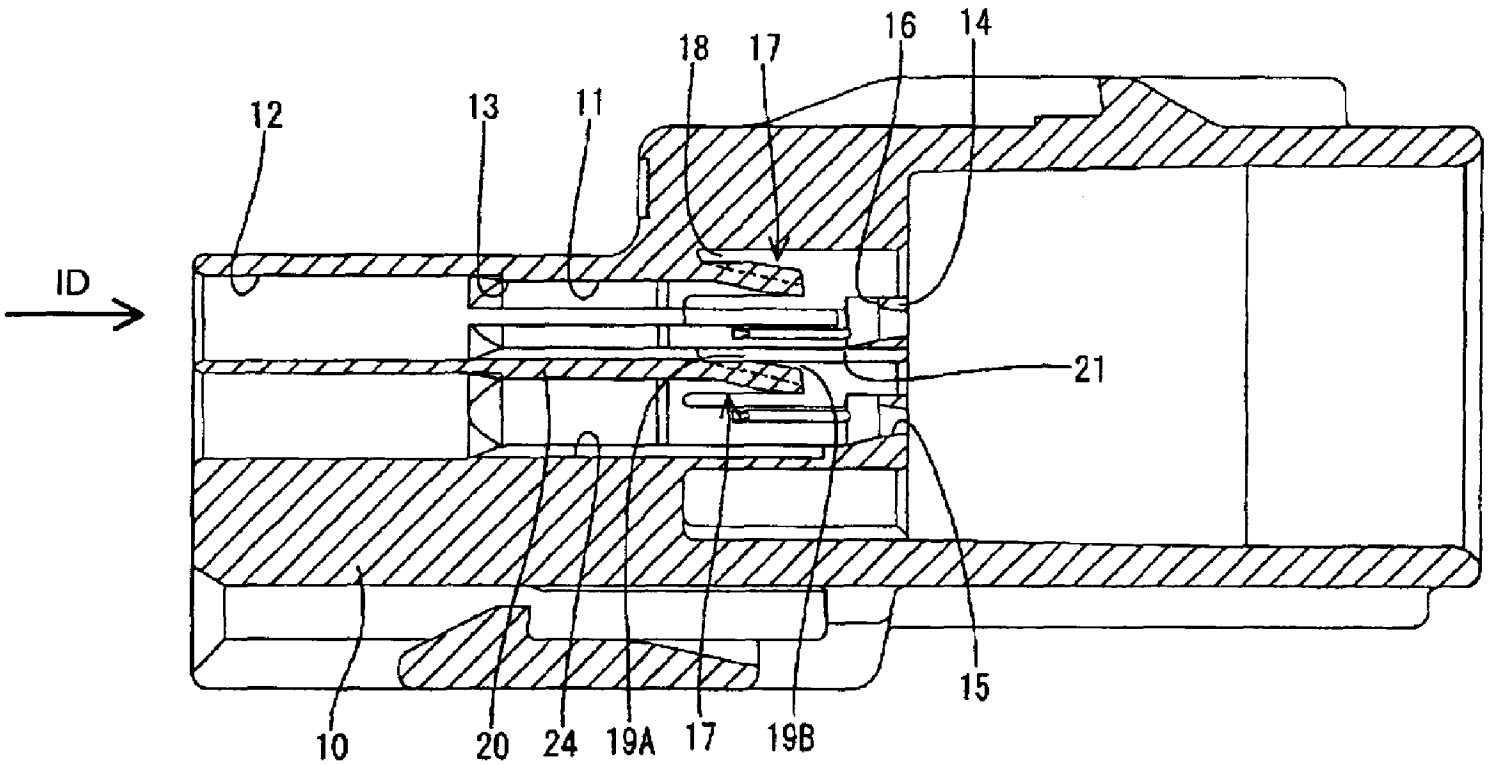
FIG. 2 is a section of a housing.
Figure 3:
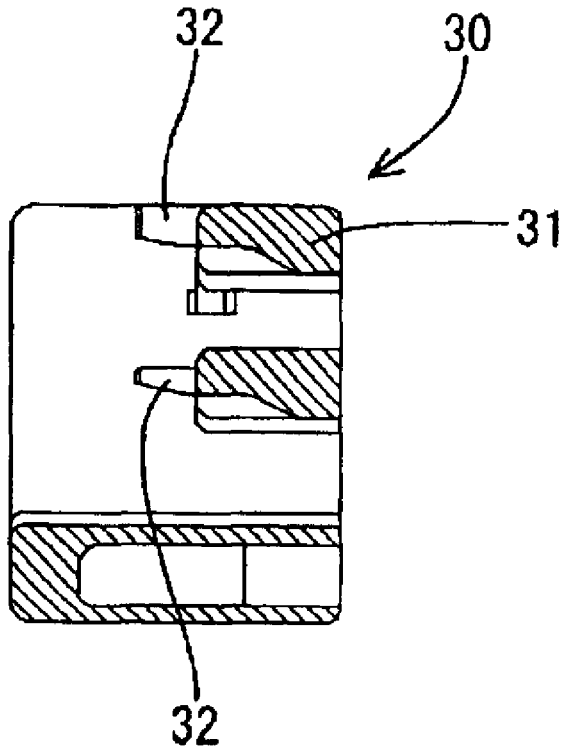
FIG. 3 is a section of a front retainer.

A connector according to the invention has a housing identified by the numeral 10 in FIGS. 1 to 10. The housing 10 is formed e.g. of a synthetic resin and has cavities 11 that open at opposite front and rear ends of the housing 10. The cavities 11 are arranged substantially side by side at upper and lower stages. A substantially round sealing surface 12 is defined on the inner periphery of the rear end of each cavity 11. A portion of each cavity 11 before the sealing surface 12 has a substantially rectangular cross section, and a step-shaped receiving portion 13 is formed on the ceiling before the sealing surface 12. The receiving portion 13 is more backward than the longitudinal center of the cavity 11.

A front wall 14 stands up from the front end of the bottom wall of the cavity 11 and has an opening 15 for receiving a tab of a male terminal fitting. A substantially flat receiving surface 16 projects from the rear of the front wall 14 above the opening 15 and is aligned substantially normal to an inserting direction ID into the cavity 11.

A transversely symmetrical lock 17 is cantilevered forward from a front portion of the ceiling wall of each cavity 11. Each lock 17 has a thick middle 17A with a relatively large vertical dimension and thin sides 17B with relatively small vertical dimensions. Lower surfaces of the thick and thin portions 17A, 17B face into the respective cavity 11 and are substantially continuous and flush with each other. However, the thick middle 17A projects up beyond the thin sides 17B at the upper surface of the lock 17. Accordingly, the lock 17 has a substantially triangular or convex shape when seen in cross-section, and the thick middle 17A defines an apex. The front bottom edge of the lock 17 defines a locking section 17C for engaging a terminal fitting.

Each cavity 11 at the upper stage has a deformation permitting space 18 that opens to the front end of the housing 10. Each cavity 11 at the lower stage has deformation permitting spaces 19A, 19B that correspond respectively to the thick middle 17A and the thin sides 17B of the respective lock 17. The deformation permitting space 19A for the thick middle 17A vertically penetrates the widthwise center of a partition wall 20 between the upper and lower cavities 11 and provides communication between the upper and lower cavities 11. Thus, the upper surface of the thick middle 17A of each lock 17 in the lower stage directly faces the cavity 11 at the upper stage. The deformation permitting spaces 19B for the thin sides 17B cut partially into the opposite sides of the bottom of the partition wall 20 to define left and right excessive deformation preventing portions 21 that contact the thin sides 17B and prevent deformation of the lock 17 beyond its resiliency limit. The deformation permitting spaces 19A, 19B for the lower stage cavities 11 also open to the front of the housing 10.

The connector also includes a front retainer 30 made e.g. of a synthetic resin. The front retainer 30 has fittable portions 31 that fit into mold removal spaces formed in the front of the housing 10 during the molding of the locks 17 and the deformation permitting spaces 18, 19A, 19B. Deformation preventing portions 32 project from the fittable portions 31 and into the respective deformation permitting spaces 18, 19B for preventing deformation of the locks 17 into the deformation permitting spaces 18, 19A, 19B. Left and right deformation preventing portions 32 are provided for each lock 17 and correspond to the two thin portions 17B of each lock 17.

The deformation preventing portions 32 that fit into the deformation permitting spaces 18 at the upper stage contact the upper surfaces of the thin sides 17B and the ceiling surfaces of the deformation permitting spaces 18 to prevent deformation of the locks 17. The deformation preventing portions 32 that fit into the deformation permitting spaces 19B at the lower stage contact the upper surfaces of the thin sides 17B and the excessive deformation preventing portions 21 on the lower surfaces of the partition walls 20 to prevent deformation of the locks 17. In this way, the deformation preventing portions 32 are inserted into recessed spaces formed by a difference in the thickness of the thick middle 17A and thin sides 17B of the locks 17.

The connector further includes terminal fittings 40. Each terminal fitting 40 is narrow and long in forward and backward directions and is formed by bending, embossing and/or folding a metallic plate material stamped or cut into a specified shape. A longitudinal middle portion of the terminal fitting 40 is formed into a substantially rectangular tube 41 with first and second side plates that stand up at the opposite lateral edges of a bottom plate. Inner plates 42 extend in from the front and rear ends of the upper edge of first side plate, and outer plates 43 extend in from the front and rear ends of the upper edge of the second side plate. The outer plates 43 are placed on the upper or outer surfaces of the inner side plates 42. A receiving plate 44 extends in from a substantially middle part of the upper edge of the first side plate between the two inner plates 42 and is engaged with the upper end of the second side plate. The rear ends of the front inner and outer plates 42 and 43 are substantially vertically continuous and flush with each other to define a securing portion 45.

An upside-down insertion preventing portion 46 is formed by making a cut in the bottom plate of the rectangular tube 41 at a substantially widthwise middle position near the front end and bending this cut portion down out. Alternatively, the upside-down insertion preventing portion 46 may be formed by embossing. The front surface of the upside-down insertion preventing portion 46 is substantially normal to the inserting direction ID of the terminal fitting 40 into the cavity 11. The upside-down insertion preventing portion 46 is disposed such that a distance between the front wall 14 of the cavity 11 and the upside-down insertion preventing portion 46 with the terminal fitting 40 inserted to a proper insertion position is less than a distance between the front wall 14 and the front end of the lock 17 (see FIG. 5(*a*)). Thus, the upside-down insertion preventing portion 46 of the terminal fitting 40 inserted into the cavity 11 at the upper stage directly faces the corresponding cavity 11 at the lower stage through the deformation permitting space 19A of the partition wall 20. However, this upside-down insertion preventing portion 46 will not interfere with the lock 17 at the lower stage when the terminal fitting 40 is inserted properly.

A coupling portion 47 is formed at the front of the rectangular tube 41 and tapers toward the front in a substantially pyramidal shape. The bottom plate and the opposite side plates of the coupling portion 47 are substantially continuous with those of the rectangular tube 41, and the upper plate of the coupling portion 47 extends in from the upper edge of one side plate thereof. An overlay plate 48 extends from the front end of the front outer plate 43 of the rectangular tube 41 and slopes moderately down to the front. The overlay plate 48 is placed on the outer surface of the upper plate of the coupling portion 47. The front end of the overlay plate 48 substantially reaches the front end of the coupling portion 47 and a long narrow tab 49 projects forward from the coupling portion 47. The front end of the overlay plate 48 is curved slightly so as to be substantially parallel with the inserting direction ID of the terminal fitting 40 into the cavity 11. A contact surface 50 is defined at the front end of the overlay plate 48 and is substantially normal to the inserting direction ID of the terminal fitting 40 into the cavity 11.

The tab 49 is formed by vertically folding a plate piece extending forward from the upper and lower plates and one side plate of the coupling portion 47 into a U-shape, such that upper and lower parts of the folded plate face each other. Thus, the tab 49 is connectable with an unillustrated mating female terminal fitting. A wire connecting portion 52 extends from the rear end of the rectangular tube 41. The wire connecting portion 52 is in the form of an open barrel formed by bending or folding pieces that stand up from the opposite lateral edges of a bottom plate. The wire connecting portion 52 is crimped, bent or folded into connection with an insulation coating 53*a* and a core 53*b* of a wire 53. A watertight rubber plug 54 is mounted on the wire 53 behind the wire connecting portion 52 and is insertable into the housing 10 for contact with the sealing surface 12.

Figure 4:
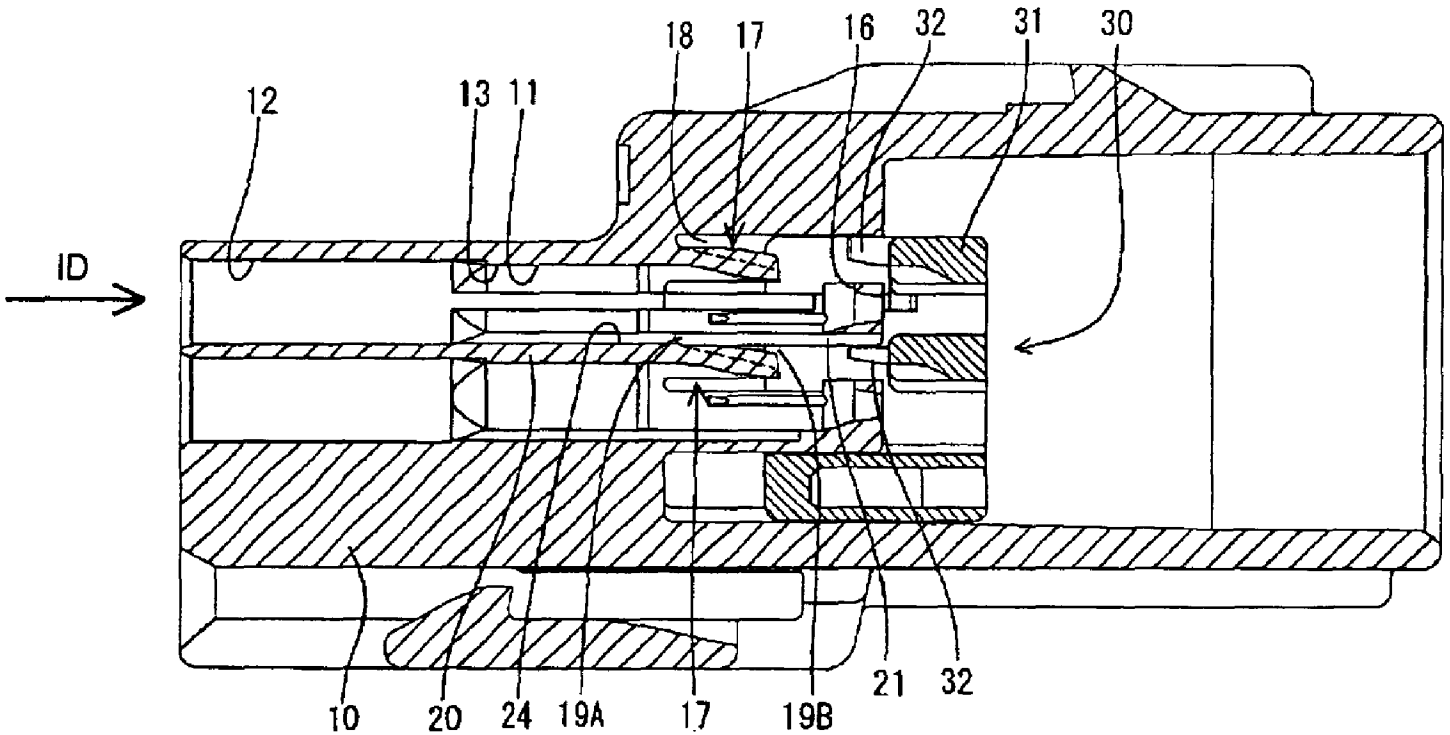
FIG. 4 is a section showing a state where the front retainer is held at a partial locking position in the housing.
Figure 5A:
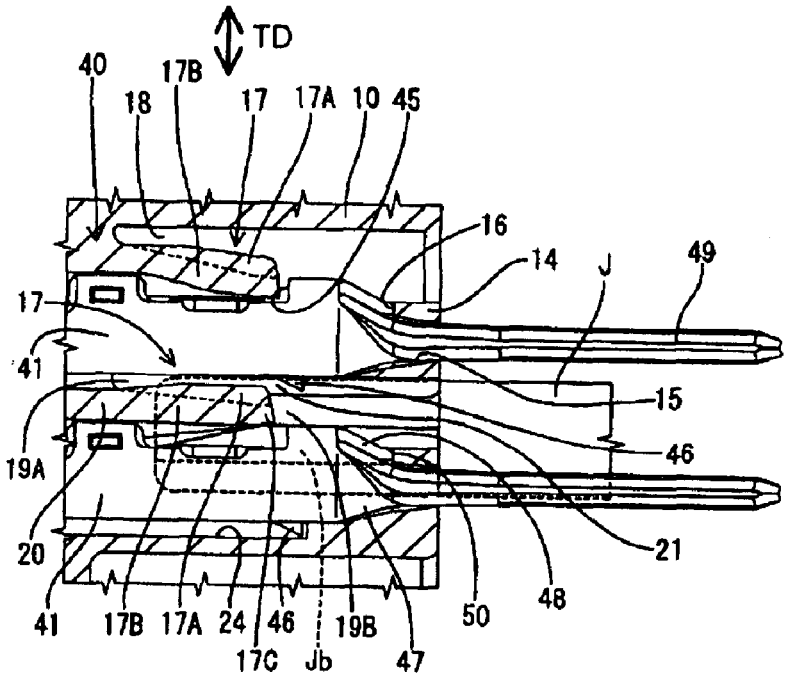
FIGS. 5(*a*) and 5(*b*) are a section showing a state where a lock is resiliently deformed by a withdrawing jig to free a terminal fitting from its locked state, and a side view of the withdrawing jig, respectively.
Figure 5B:
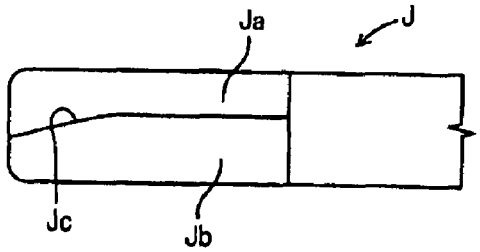

The connector of this embodiment is assembled by first mounting the front retainer 30 at a partial locking position in the housing 10. The deformation preventing portions 32 are spaced forward from the front ends of the locks 17, as shown in FIG. 4, when the front retainer 30 is at the partial locking position. Thus, the locks 17 can deform toward the deformation permitting spaces 18, 19A, 19B. Each terminal fitting 40 then is inserted in the inserting direction ID into the corresponding cavity 11. The front end of the upper surface of the rectangular tube 41 contacts the lower surface of the lock 17 when the terminal fitting 40 nears the proper insertion position. Thus, the lock 17 resiliently deforms up away from the terminal fitting 40 and into the deformation permitting space 18 or 19A, 19B. The front end of the front outer plate 43 of the terminal fitting 40 is smoothly continuous with the overlay plate 48 that extends obliquely down. Accordingly, there is no possibility of damaging the lower surface of the lock 17.

The lock 17 is restored resiliently when the terminal fitting 40 reaches the proper insertion position and the locking section 17C at the front end of the lock 17 engages the securing portion 45 on the upper surface of the rectangular tube 41 from behind. As a result, the terminal fitting 40 is locked and cannot make loose backward movements. Further, the contact surface 50 of the terminal fitting 40 contacts the receiving surface 16 of the cavity 11 to prevent any further forward movement of the terminal fitting 40. Both the contact surface 50 and the receiving surface 16 are substantially normal to the inserting direction ID of the terminal fitting 40 into the cavity 11. Accordingly, the terminal fitting 40 can be held precisely at its front-limit position.

The upside-down insertion preventing portion 46 projects from the bottom surface of the rectangular tube 41 and moves along the escaping groove 24 in the bottom surface of the cavity 11 during the insertion of the terminal fitting 40. A front end of the escaping groove 24 of each cavity 11 at the upper stage shares the space with the deformation permitting space 19A. The tab 49 projects out of the housing 10 through the opening 15 at the leading end of the cavity 11 when the terminal fitting 40 is inserted properly. The rubber plug 54 is held in close contact with the sealing surface 12 at the rear end of the cavity 11 to prevent the entrance of water into the cavity 11 from behind.

The front retainer 30 is pushed to a full locking position, as shown in FIG. 1, after all of the terminal fittings 40 are inserted. Thus, the deformation preventing portions 32 enter the deformation permitting spaces 18, 19B to face the upper surfaces of the thin sides 17B of the locks 17. Contact of the thin sides 17B with the deformation preventing portions 32 prevent the locks 17 from being deformed toward the deformation permitting spaces 18, 19A, 19B and thus the locks 17 are held while being engaged with the terminal fittings 40. In this way, the terminal fittings 40 are locked doubly and are prevented from coming out.

A terminal fitting 40 might be inserted insufficiently when the front retainer 30 is pushed toward the full locking position. However, the lock 17 deformed by this terminal fitting 40 is still in the deformation permitting space 18, 19B. Thus, the deformation preventing portions 32 contact the lock 17 and the front retainer 30 cannot be pushed any further. Therefore, the presence of the insufficiently inserted terminal fitting 40 can be detected.

Figure 6:
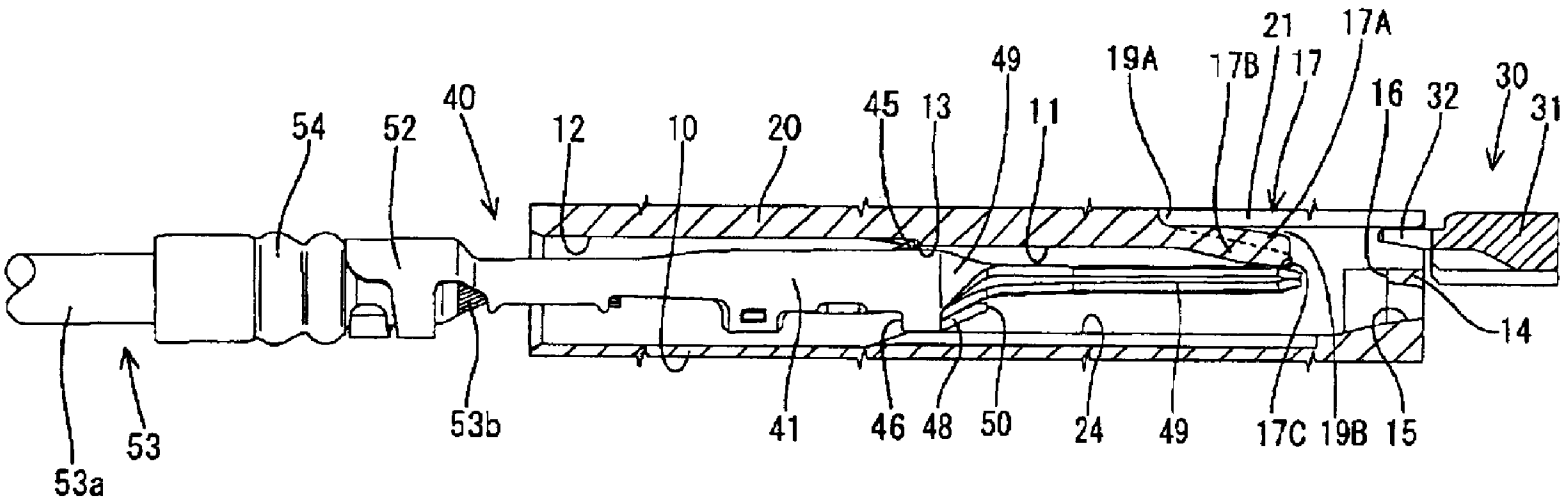
FIG. 6 is a section showing a state where the terminal fitting is inserted upside down.
Figure 7A:
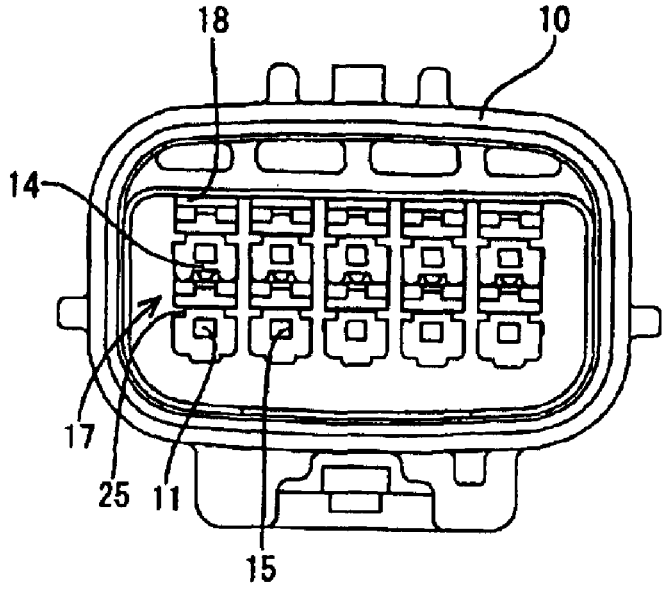
FIGS. 7(*a*) and 7(*b*) are a front view of only the housing, and a front view of the housing having the front retainer mounted therein, respectively.
Figure 7B:
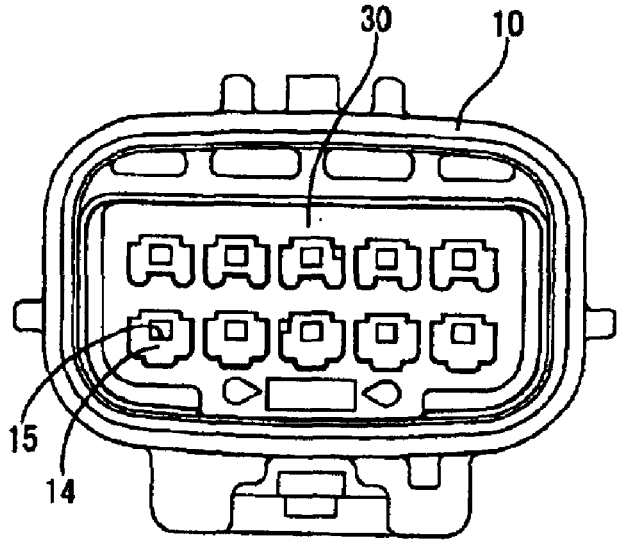

An attempt might be made to insert a terminal fitting 40 upside down. However, the upside-down insertion preventing portion 46 of the terminal fitting 40 engages the receiving portion 13 of the cavity 11 from behind, as shown in FIG. 6, and further insertion of the terminal fitting 40 is hindered. An operator can notice that the terminal fitting 40 is held upside down by this hindrance to the inserting operation. The front end of the tab 49 cannot reach the front wall 14 of the cavity 11 if the insertion is hindered in this way because the distance between the front wall 14 of the cavity 11 and the receiving portion 13 exceeds the distance between the upside-down insertion preventing portion 46 and the leading end of the tab 49.

Figure 8A:
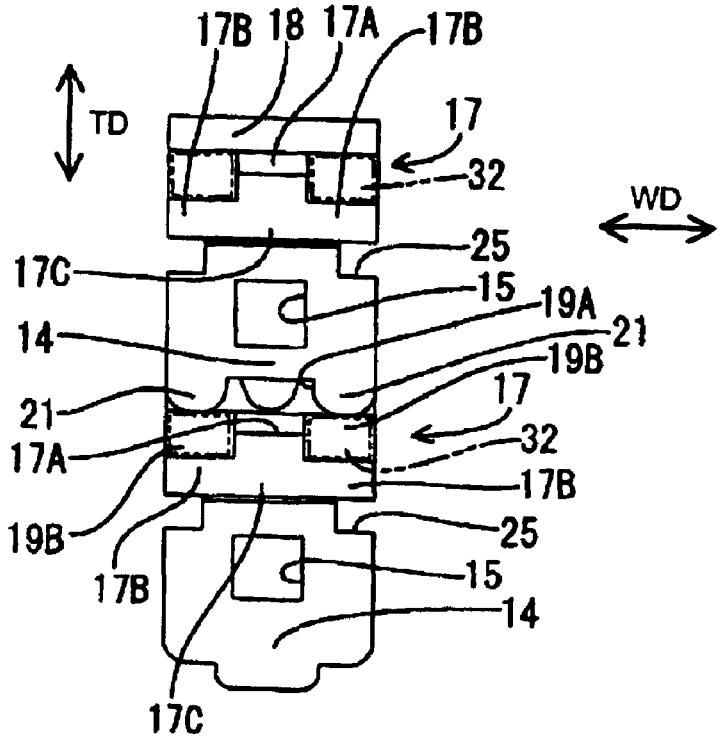
FIG. 8(A) is a partial enlarged front view of the housing and FIG. 8(B) is a partial enlarged front view showing only the lock.
Figure 8B:
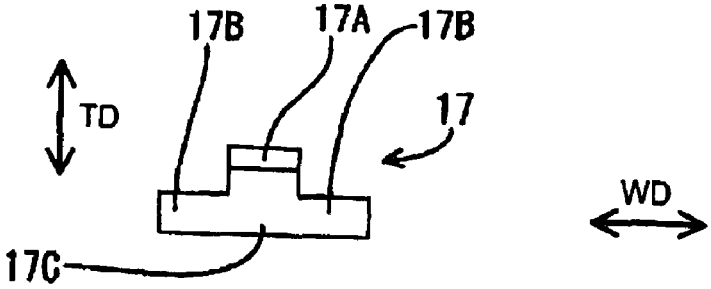
Figure 9:
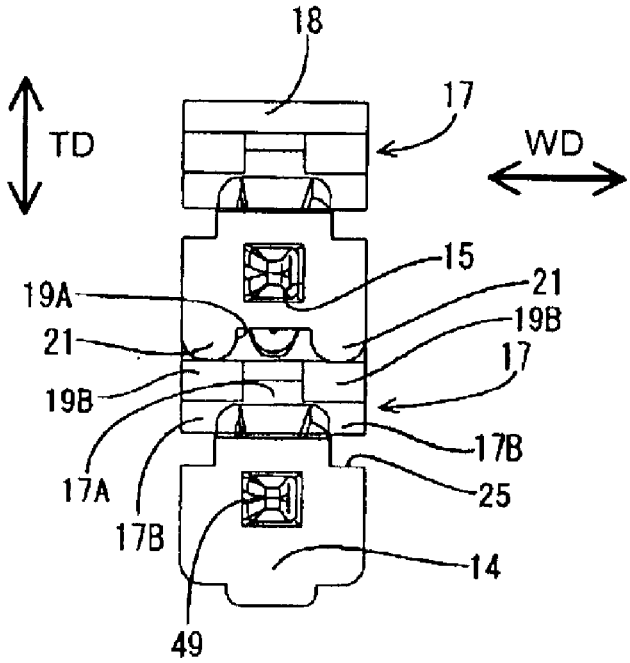
FIG. 9 is a partial enlarged front view of the housing with the terminal fittings inserted.
Figure 10:
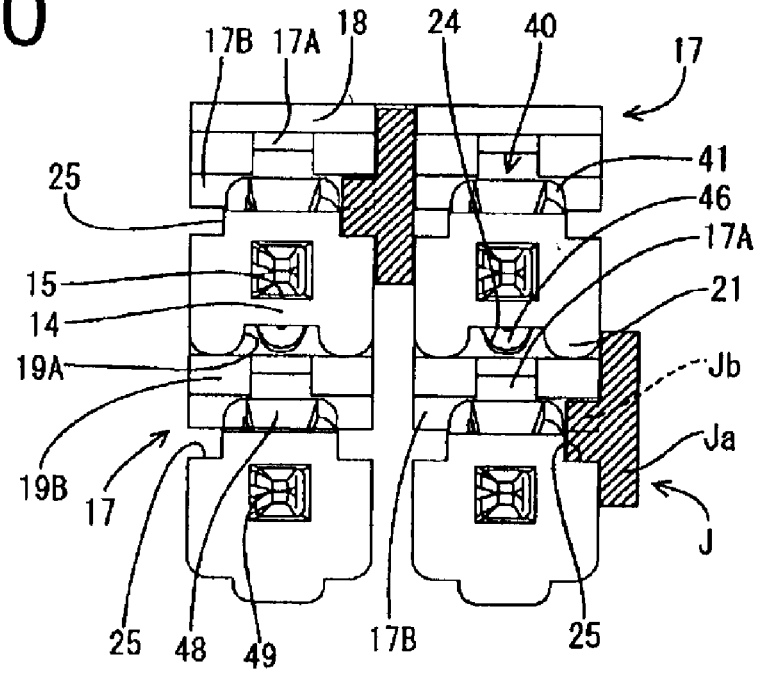
FIG. 10 is a partial front view showing a positional relationship between the locks and the withdrawing jigs.
Figure 11:
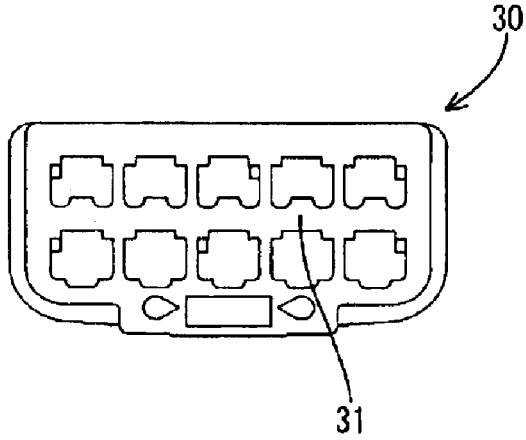
FIG. 11 is a front view of the front retainer.
Figure 12:
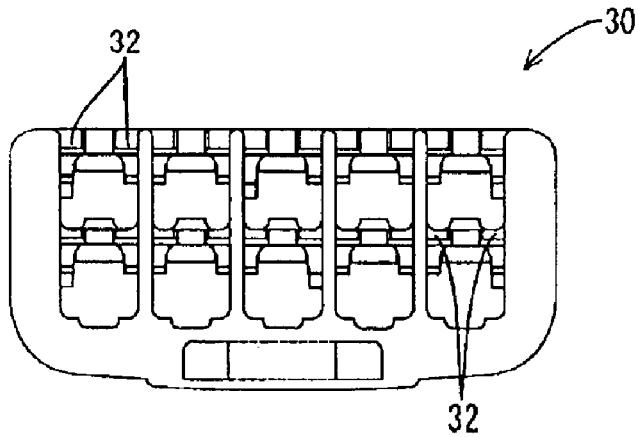
FIG. 12 is a rear view of the front retainer.
Figure 13:
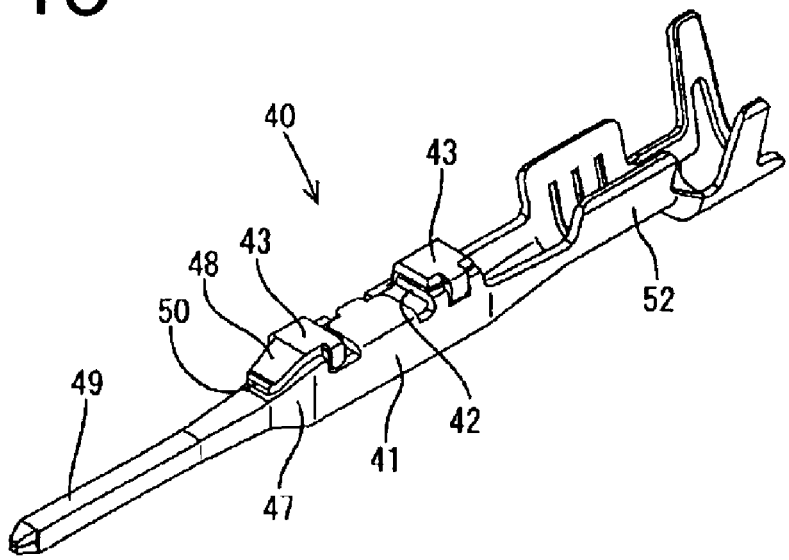
FIG. 13 is a perspective view of the terminal fitting.
Figure 14:
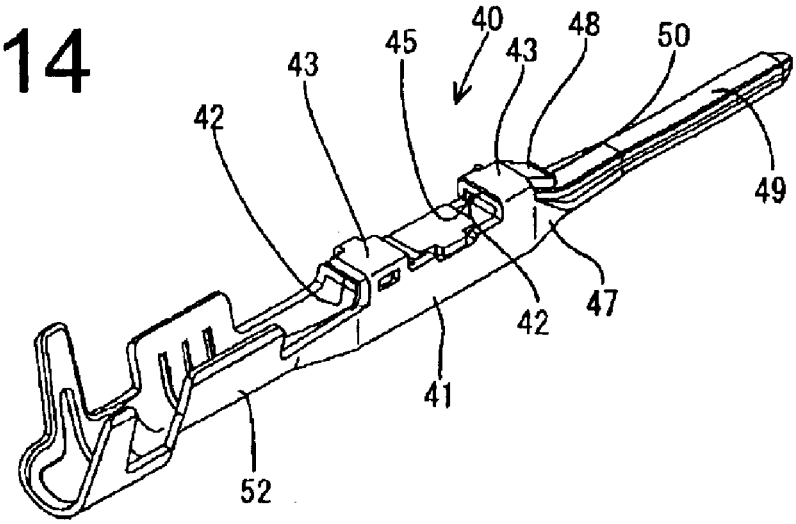
FIG. 14 is a perspective view of the terminal fitting.
Figure 15:
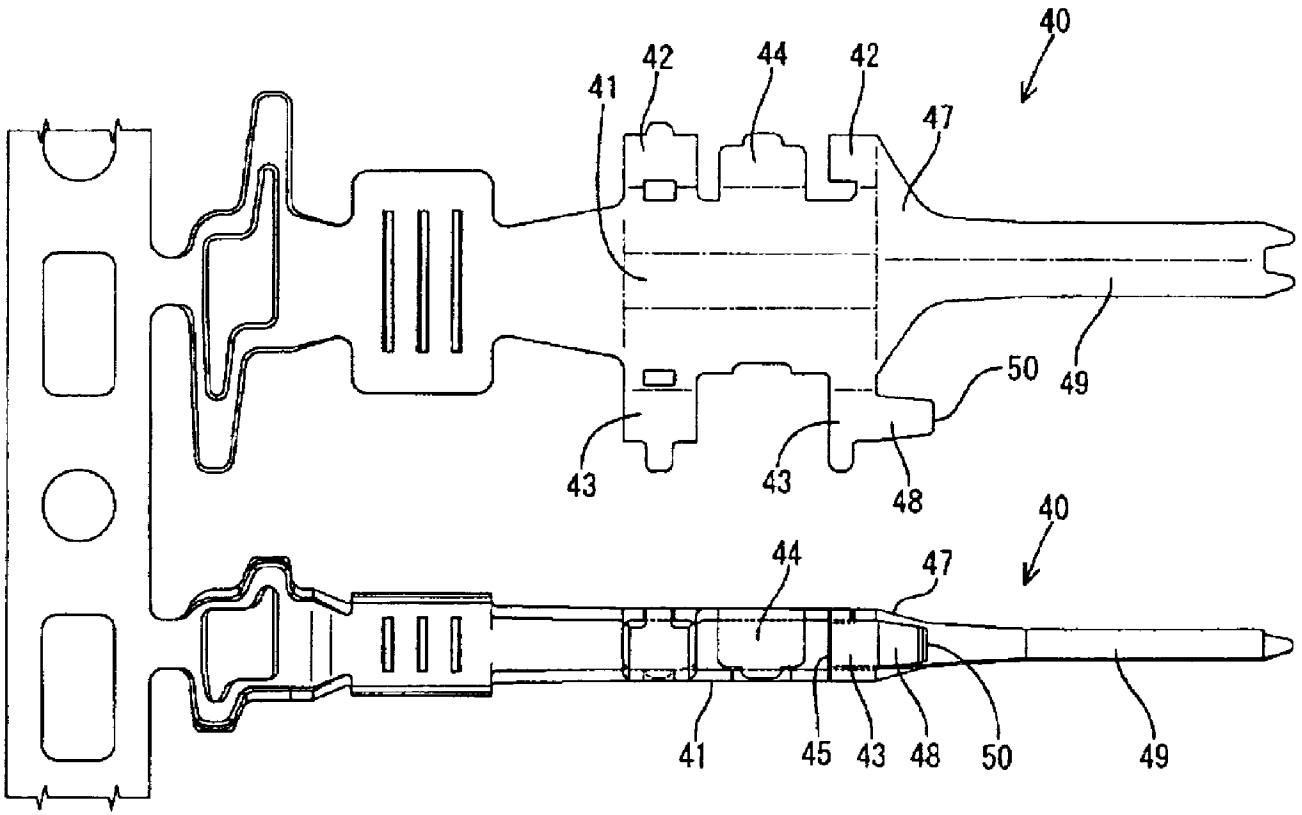
FIG. 15 is a plan view showing a manufacturing process of terminal fittings.
Figure 16:
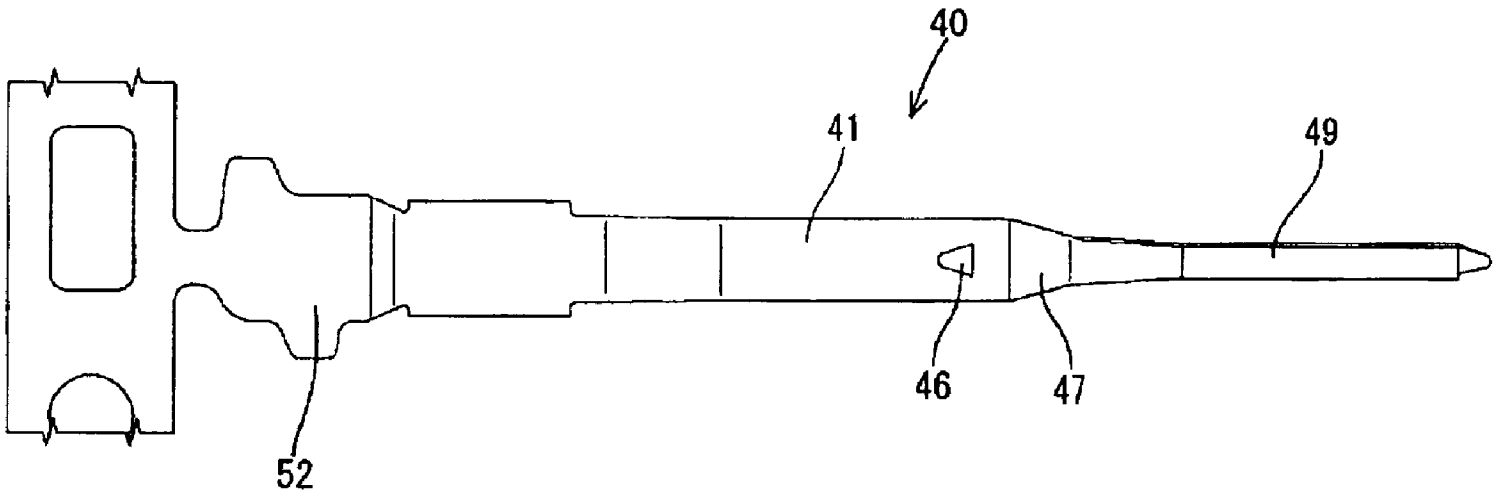
FIG. 16 is a bottom view of the terminal fitting.

The inserted terminal fitting 40 is withdrawn by first detaching the front retainer 30 from the housing 10. A withdrawing jig J then is inserted into the housing 10 from the front. The withdrawing jig J has a long base plate Ja, a pushing portion Jb that projects from a side of the base plate Ja, and a slanted guide surface Jc at the leading end of the pushing portion Jb with respect to an inserting direction of the withdrawing jig J into the housing 10. The locks 17 are wider than the terminal fittings 40 so that the thin sides 17B of the locks 17 project laterally beyond the terminal fittings 40, as shown in FIGS. 8 to 10. The upper ends of the side walls of the cavities 11 are cut to be lower than the upper surfaces of the thin sides 17B of the locks. Additionally, withdrawal spaces 25 are defined between the upper ends of the side walls and the lower surfaces of the thin sides 17B and open at the front end surface of the housing 10. The pushing portion Jb can be inserted into the withdrawal space 25 so that the guide surface Jc contacts the lower surface of the thin side 17B. Thus, the lock 17 is deformed up by the inclination of the guide surface Jc to disengage the locking section 17C at the front end of the lock 17 from the securing portion 45 of the terminal fitting 40 as the withdrawing jig J is inserted further. In this way, the terminal fitting 40 is freed from its locked state, and the terminal fitting 40 can be withdrawn from the cavity 11 by pulling on the wire 53.

Each lock 17 has the thick middle 17A and the thin sides 17B formed by partially cutting the upper surface of the lock 17 facing the deformation permitting spaces 18, 19A, 19B along a widthwise direction. The deformation preventing portions 32 are inserted into the spaces formed by the difference in thickness between the thick middle 17A and the thin sides 17B and contact the upper surfaces of the thin sides 17B to prevent deformation of the lock 17. Thus, the locks 17 and the deformation preventing portions 32 overlap along thickness direction TD, which is the deformation direction of the lock 17, and the connector can be made smaller due to overlapping thickness.

Each lock 17 is thinned over part of the entire width, and therefore a sufficient strength is secured for the entire lock 17. Further, the deformation permitting spaces 19B corresponding to the thin sides 17B have a large height, and the thickness of the deformation preventing portions 32 that contact the thin sides 17B can be made larger so that a sufficient strength can be secured for the deformation preventing portions 32.

The deformation permitting space 19A for the thick middle 17A is formed by partially cutting a center portion of each partition wall 20 between the vertically adjacent cavities 11. Additionally, the deformation preventing portions 32 fit into the deformation permitting spaces 19B between the thin sides 17B and the partition wall 20 that separates vertically adjacent cavities 11. Thus, the deformation permitting spaces 19A for the thick middles 17A of the locks 17 at the lower stage and the partition walls 20 between the vertically adjacent cavities 11 overlap along the vertical direction, which is the deflection direction of the lock 17. Therefore, the connector can be made shorter by this overlapping thickness.

The thick middle 17A of each lock 17 projects more toward the deformation permitting space than the thin sides 17B. Thus, a degree of the resilient deformation of the lock 17 is restricted. However, the deformation permitting space 19A for the thick middle 17A is formed in the partition wall 20 between the vertically adjacent cavities 11. Thus, the degree of the resilient deformation of the lock 17 can be larger, and an area of engagement of the lock 17 and the terminal fitting 40 is increased to lock the terminal fitting 40 with improved reliability.

The deformation permitting space 19A for the thick middle 17A of the locks 17 in the lower stage communicates with the cavities 11 above the partition wall 20. Thus, the lock 17 can be deformed more than with a deformation permitting space formed merely by a groove in a partition wall. The deformation of the lock 17 cannot be restricted by the contact of the thick middle 17A of the lock 17 with the partition wall 20 because the deformation permitting space 19A communicates with the vertically adjacent cavities 11. However, the excessive deformation preventing portions 21 are provided in the areas of the partition wall 20 corresponding to the thin sides 17B. Therefore, the lock 17 is prevented from excessive deformation.

The lock 17 is substantially transversely symmetrical. Thus, the rigidity of the lock 17 also is transversely symmetrical, and the lock 17 is not displaced to the left or right side when being deformed during insertion of the terminal fitting 40.

The locks 17 at the lower stage also are part of the partition walls 20 between the vertically adjacent cavities 11 for achieving miniaturization. Additionally, the upside-down insertion preventing portions 46 and the locks 17 are arranged so as not to interfere with each other along the inserting direction ID of the terminal fittings 40. Accordingly, the upside-down insertion preventing portions 46 do not interfere with the vertically adjacent locks 17 at the lower stage even though both the upside-down insertion preventing portions 46 and the locks 17 are near the front end and are on opposite sides. Therefore, insertion resistance can be reduced and early detection of an upside-down insertion can be realized by causing the locks 17 to serve as the partition walls 20 between the vertically adjacent cavities 11 for the miniaturization of the connector and enabling both the upside-down insertion preventing portions 46 and the locks 17 to be near the front.

The front end of the tab 49 has not yet reached the front wall 14 when any further insertion of an upside down terminal fitting 40 is prevented by contact of the upside-down insertion preventing portion 46 with the receiving portion 13. Thus, the tab 49 will not strike against the front wall 14 and be deformed.

Each lock 17 has the thin sides 17B and each partition wall 20 between vertically adjacent cavities 11 has the excessive deformation preventing portions 21. Thus, excessive deformation of the lock 17 beyond its resiliency limit can be prevented, while the desired resilient deformation of the lock 17 is permitted.

The male terminal fitting 40 inserted into the cavity 11 is stopped at its front-limit position along the inserting direction ID by contact between the contact surface 50 of the male terminal fitting 40 and the receiving surface 16 in the cavity 11 substantially in the same direction as the inserting direction of the male terminal fitting 40. Thus, the male terminal fitting 40 can be stopped securely at the specified proper insertion position and will not move further forward.

The coupling portion 47 of the terminal fitting 40 is formed with a press that deforms the front end of the rectangular tube 41 into a tapered shape, and hence the coupling portion 47 is potentially weak. However, the coupling portion 47 is reinforced by the overlay plate 48 and is not likely to deform.

The outer edge of the contact surface 50 of the terminal fitting 40 is a sharp edge, but is more inward than the outer surface of the rectangular tube 41 since the contact surface 50 is at the front end of the tapered coupling portion 47. Accordingly, the outer edge of the contact surface 50 does not damage the inner walls during the insertion of the male terminal fitting 40.

The front outer plate 43 and the overlay plate 48 of the rectangular tube 41 are made of a single plate, and a boundary between them at the front end of the rectangular tube portion 41 is a relatively smoothly bent surface having no sharp edge. Thus, the front end of the rectangular tube 41 will not damage the inner wall portions of the cavity 11 during the insertion of the male terminal fitting 40.

The lock 17 engages the double-plate portion formed by the inner and outer plates 42, 43 of the rectangular tube 41. Thus, a larger area of engagement can be attained as compared to a case where the lock is engaged with a portion formed by cutting a single plate.

The invention is not limited to the above described and illustrated embodiment. For example, the following embodiments are also embraced by the technical scope of the present invention as defined in the claims. Beside the following embodiments, various changes can be made without departing from the scope and spirit of the present invention as defined in the claims.

Although the invention is applied to a male terminal fitting having a tab in the foregoing embodiment, it is also applicable to female terminal fittings.

Each partition wall between the vertically adjacent cavities is cut over the substantially entire thickness at its portion corresponding to the thick middle of the lock to substantially communicate the cavities in the foregoing embodiment. However, it may be formed with a groove to be thinned at a portion corresponding to the thick middle of the lock according to the present invention.

Although the locks are transversely symmetrical in the foregoing embodiment, they may be transversely asymmetrical.

In the foregoing embodiment, thin portions are provided at the opposite sides of the thick middle in each lock. Conversely, a pair of thick sides may be symmetrically provided at opposite sides of the thin middle according to the present invention.

What is claimed is:

1. A connector with a housing having opposite front and rear ends and cavities extending between the ends, locks cantilevered in the housing and extending forward substantially along an inner wall surface of each said cavity, deformation permitting spaces formed in he housing for permitting resilient deformation of the locks; terminal fittings inserted respectively into the cavities in an insertion direction and locked by the corresponding locks, each said lock comprising at least one thin portion formed by partially cutting along a widthwise direction a surface of lock substantially facing the deformation permitting space, and a thick portion thicker than the thin portion and a retainer with deformation preventing portions that enter the deformation permitting spaces to prevent the locks from being deformed away from the terminal fittings.

2. A connector with a housing having opposite front and rear ends and cavities extending between the ends, locks cantilevered in the housing and extending forward substantially along an inner wall surface of each said cavity, deformation permitting spaces formed in the housing for permitting resilient deformation of the locks; terminal fittings inserted respectively into the cavities in an insertion direction and locked by the corresponding locks, each said lock comprising at least one thin portion formed by partially cutting along a widthwise direction a surface of the lock substantially facing the deformation permitting space, and a thick portion thicker than the thin portion, wherein each said lock is substantially transversely symmetrically with the thick portion substantially in the widthwise center and two thin portions at the opposite widthwise sides of the thick portion.

3. The connector of claim 1, wherein each deformation preventing portion is engageable in a recessed space formed by a difference in thickness between the thick portion and the thin portion for contacting the thin portion and preventing deformation of the lock.

4. The connector of claim 3, wherein the retainer is a front retainer mounted to the front end of the housing.

5. The connector of claim 1, wherein the deformation permitting spaces are defined by at least partially cutting portions of partition walls between the cavities facing the thick portions.

6. The connector of claim 5, wherein the deformation preventing portions fit into portions of the deformation permitting spaces defined between the thin portions and the partition walls between the cavities.

7. The connector of claim 5, wherein portions of each of the deformation permitting spaces facing the respective thick portion provides communication between the cavities at opposite sides of the corresponding partition wall.

8. The connector of claim 7, wherein an area of a the partition wall opposed to the thin portion defines an excessive deformation preventing surface for preventing an excessive deformation of the corresponding lock by contacting the thin portion.

9. The connector of claim 2, wherein the lock has an end with a locking section for engaging and locking the terminal fitting.

10. A connector with a housing having opposite front and rear ends and cavities extending between the ends, deformation permitting spaces formed in the housing substantially adjacent the respective cavities, elongate locks cantilevered forwardly in the housing between the respective cavities and the deformation permitting spaces, each said lock having a surface facing the respective cavity and a surface facing the deformation permitting space, the surface of the lock facing the deformation permitting space being convex from side to side, such that each said lock has a thick portion and at least one thin portion and a partition wall between a first of the cavities and the deformation permitting space associated with a second of the cavities, the partition wall having a cut out at a location aligned with the thick portion of the lock of the second cavity.

11. A connector with a housing having opposite front and rear ends and cavities extending between the ends, deformation permitting spaces formed in the housing substantially adjacent the respective cavities, elongate locks cantilevered forwardly in the housing between the respective cavities and the deformation permitting spaces, each said lock having a surface facing the respective cavity and a surface facing the deformation permitting space, the surface of the lock facing the deformation permitting space being convex from side to side, such that each said lock has a thick portion and at least one thin portion, and a retainer with deformation preventing portions that enter the deformation permitting spaces to prevent the locks from being deformed away from the cavities.

12. The connector of claim 11, wherein each said elongate lock is symmetrical about a longitudinal axis thereof.

13. The connector of claim 12, wherein each said lock has two of said thin portions disposed on opposite respective sides of the thick portion.

14. The connector of claim 10, wherein an area of the partition wall opposed to the thin portion defines an excessive deformation preventing surface for preventing an excessive deformation of the corresponding lock by contacting the thin portion.

15. The connector of claim 11, wherein each said deformation preventing portion is engageable in a recessed space formed by a difference in thickness between the thick portion and the thin portion for contacting the thin portion and preventing deformation of the lock.

16. The connector of claim 11, wherein the retainer is a front retainer mounted to the front end of the housing.

* * * * *